US005236048A

United States Patent [19]

Skinner et al.

[11] Patent Number: 5,236,048

[45] Date of Patent: Aug. 17, 1993

[54] APPARATUS AND METHOD FOR COMMUNICATING ELECTRICAL SIGNALS IN A WELL, INCLUDING ELECTRICAL COUPLING FOR ELECTRIC CIRCUITS THEREIN

[75] Inventors: Neal G. Skinner, Lewisville; Robert A. Moore, Katy; Gregory A. Kliewer, North Richland Hills; Roger L. Schultz, Richardson; Harold K. Beck, Copper Canyon; Kevin R. Manke, Flower Mound; Paul D. Ringgenberg, Carrollton, all of Tex.

[73] Assignee: Halliburton Company, Duncan, Okla.

[21] Appl. No.: 807,027

[22] Filed: Dec. 10, 1991

[51] Int. Cl.[5] ..... E21B 17/02

[52] U.S. Cl. ..... 166/382; 166/65.1

[58] Field of Search ..... 166/382, 65.1; 439/190, 439/196, 197, 198, 199, 201, 205

[56] References Cited

U.S. PATENT DOCUMENTS

| | | | |
|---|---|---|---|
| Re. 31,524 | 2/1984 | Hoebel | 307/149 |
| 2,301,783 | 11/1942 | Lee | 173/326 |
| 2,354,887 | 8/1944 | Silverman et al. | 177/352 |
| 2,370,818 | 3/1945 | Silverman | 177/352 |
| 2,379,800 | 7/1945 | Hare | 175/356 |
| 2,414,719 | 1/1947 | Cloud | 178/44 |
| 2,829,338 | 4/1958 | Lord | 324/34 |
| 3,079,549 | 2/1963 | Martin | 324/1 |
| 3,090,031 | 5/1963 | Lord | 340/18 |
| 3,112,442 | 11/1963 | Bennett | 324/1 |
| 3,186,222 | 6/1965 | Martin | 73/151 |
| 3,227,973 | 1/1966 | Gray | 333/78 |
| 3,233,674 | 2/1966 | Leutwyler | 166/63 |
| 3,323,091 | 5/1967 | Hibbits | 336/84 |
| 3,387,606 | 6/1968 | Crafts et al. | 128/141 |
| 3,408,561 | 10/1968 | Redwine et al. | 324/6 |
| 3,490,286 | 1/1970 | Schwartz | 73/362 |
| 3,568,053 | 3/1971 | Kilpatrick et al. | 324/62 |
| 3,732,728 | 5/1973 | Fitzpatrick | 73/151 |
| 3,742,408 | 6/1973 | Jaeger | 336/5 |
| 3,743,989 | 7/1973 | Nicolas et al. | 336/5 |
| 3,879,097 | 4/1975 | Oertle | 339/16 R |
| 3,991,611 | 11/1976 | Marshall, III et al. | 73/151 |
| 3,995,209 | 11/1976 | Weston | 323/44 R |
| 4,057,781 | 11/1977 | Scherbatskoy | 340/18 LD |

(List continued on next page.)

FOREIGN PATENT DOCUMENTS

| | | | |
|---|---|---|---|
| 259770 | 10/1970 | U.S.S.R. | 166/65.1 |
| 447495 | 6/1975 | U.S.S.R. | 166/65.1 |
| 1320391 | 6/1987 | U.S.S.R. | 166/65.1 |
| 1557863 | 12/1979 | United Kingdom . | |

OTHER PUBLICATIONS

Flopetrol literature including five unnumbered pages and pp. 184–187 and 190–194 (Exhibit A) (more than one year before Nov. 1991).

Four pages describing the Halliburton SRO system (Exhibit B) (more than one year before Nov. 1991).

*Primary Examiner*—William P. Neuder

*Attorney, Agent, or Firm*—James R. Duzan; C. Dean Domingue; E. Harrison Gilbert, III

[57] ABSTRACT

An electric coupling for two electric circuits in a well includes an electric contact and a contact receiver connected to respective ones of the circuits so that a contact/receiver pair is formed when the contact and receiver are moved together The receiver is sealed by a sealing member. The sealing member is disposed so that it is penetrated by the contact when the contact and receiver are moved together. A coupling including two such pairs is preferably used to connect two electric wires in the well to form a current conductive loop linking two electric coils. One of the coils is adapted to be moved in the well relative to the other coil which is adapted to be fixed in the well. In a preferred embodiment, one coil is on a wireline tool and the other coil is on a downhole tool. The current conductive path established across an intervening space between the tools is electrically insulated from the bodies of the tools and preferably has a resistance sufficiently low that the current conductive path is not effectively short-circuited by fluid in the intervening space which the path crosses.

29 Claims, 8 Drawing Sheets

U.S. PATENT DOCUMENTS

| | | | |
|---|---|---|---|
| 4,108,243 | 8/1978 | King et al. | 166/66 |
| 4,160,970 | 7/1979 | Nicolson | 340/18 LD |
| 4,178,579 | 12/1979 | McGibbeny et al. | 340/856 |
| 4,302,757 | 11/1981 | Still | 340/854 |
| 4,348,672 | 9/1982 | Givler | 340/854 |
| 4,468,665 | 8/1984 | Thawley et al. | 340/856 |
| 4,510,797 | 4/1985 | Guidry et al. | 73/151 |
| 4,514,809 | 4/1985 | Johnson, Jr. et al. | 364/422 |
| 4,541,275 | 9/1985 | Kerzner | 73/152 |
| 4,541,481 | 9/1985 | Lancaster | 166/65.1 |
| 4,605,268 | 8/1986 | Meador | 339/16 C |
| 4,648,471 | 3/1987 | Bordon | 175/4.55 |
| 4,678,035 | 7/1987 | Goldschild | 166/250 |
| 4,691,203 | 9/1987 | Rubin et al. | 340/856 |
| 4,790,380 | 12/1988 | Ireland et al. | 166/250 |
| 4,806,928 | 2/1989 | Veneruso | 340/856 |
| 4,852,648 | 8/1989 | Akkerman et al. | 166/66.4 |
| 4,901,069 | 2/1990 | Veneruso | 340/853 |
| 4,921,438 | 5/1990 | Godfrey et al. | 166/65.1 X |
| 4,971,160 | 11/1990 | Upchurch | 175/4.54 |

APPARATUS AND METHOD FOR COMMUNICATING ELECTRICAL SIGNALS IN A WELL, INCLUDING ELECTRICAL COUPLING FOR ELECTRIC CIRCUITS THEREIN

BACKGROUND OF THE INVENTION

This invention relates generally to apparatus and methods for communicating electrical signals, such as power and data signals, in a well. This particularly includes electrically coupling two circuits in the well so that electrical signals can be communicated from one circuit to the other.

There are electrical devices that can be lowered into wells to detect downhole conditions, such as pressure and temperature. Although some of these devices may have self-contained power supplies and data storage elements so that no communication with the surface is needed, it is sometimes desirable to have such surface/-well communication. For example, it is sometimes desirable to send one or more control signals from the surface to an electrical device in the well. Sometimes an energizing or recharging power signal may need to be sent from the surface to the device. Sending to the surface electrical signals encoded to represent the detected conditions is also desirable at least when trying to control or monitor what is happening downhole as events occur (i.e., in "real time") or when retrieving data previously stored in a downhole memory.

There have been proposals for establishing such communications between equipment or personnel at the surface and equipment down in the well. For example, electromagnetic communication has been disclosed. In one species, two coils, each associated with a respective circuit, are inductively linked without intermediate electrical current conductive connections being made. In another species, two coils communicate via an intermediate current loop formed by electrically contacting tool bodies carrying the circuits. Another type of communication is by direct electrical contact. That is, circuits are directly electrically connected by electric conductors so that current flows continuously from one circuit to another.

Even though various techniques for communicating in a well have been proposed or implemented, there is still the need for an improved apparatus and method. Such apparatus and method should be able to transfer electrical signals at relatively high transmission rates. The operations of such apparatus and method should not be adversely affected by fluid in the well capable of short-circuiting an electric circuit. Such apparatus should be readily reusable.

SUMMARY OF THE INVENTION

The present invention provides a novel and improved apparatus and method for communicating electrical signals in a well. The apparatus and method can transfer electrical signals at relatively high transmission rates. Operation of the apparatus and method is not adversely affected by fluid in the well, and the apparatus can be readily reused.

The apparatus provided by the present invention comprises: a first electric coil adapted to be moved in the well; a second electric coil adapted to be fixed in the well relative to movement of the first electric coil in the well; current conducting means for having an electric current induced therein in response to an electric current in a selected one of the first and second electric coils, and for inducing an electric current in the other of the first and second electric coils in response to the electric current induced in the current conducting means, the current conducting means including: a first electric wire linked with the first electric coil; a second electric wire linked with the second electric coil; and means for connecting the first and second electric wires in the well so that an electric current conductive wire loop links the first and second electric coils. In a particular implementation, this apparatus further comprises: a landing receptacle having the second electric coil mounted thereon, the landing receptacle having an axial opening; and a wireline tool having the first electric coil mounted thereon, the wireline tool including means for connecting the first electric coil to a wireline, and the wireline tool adapted to be moved on the wireline within the axial opening of the landing receptacle.

The method of communicating between two electric circuits in a well as provided by the present invention comprises establishing, across an intervening space in the well between the two electric circuits, a current conductive path having a resistance sufficiently low that the current conductive path is not effectively short-circuited by fluid in the intervening space crossed by the current conductive path.

In addition to providing the overall apparatus described above, the present invention provides an electric coupling for first and second electric circuits in a well. This coupling comprises: an electric contact connected to the first electric circuit; contact receiving means, connected to the second electric circuit, for receiving the electric contact; and seal means for sealing the contact receiving means and for being penetrated by the electric contact in response to connecting the electric contact and the contact receiving means together. In a preferred embodiment, the coupling further comprises means for moving the electric contact through the seal means and into the contact receiving means. In the preferred embodiment this moving means includes: support means for supporting the electric contact; and means for pivoting the support means toward the seal means.

The present invention also provides a method for coupling electric circuits in a well. This method comprises moving an electric contact, coupled to one circuit in the well, through a seal fluid tightly protecting a contact receiver, coupled to another circuit in the well, and into engagement with the contact receiver Therefore, from the foregoing, it is a general object of the present invention to provide a novel and improved apparatus and method for communicating electrical signals in a well. Within such apparatus and method there are particularly provided an apparatus and method for coupling electric circuits in a well. Other and further objects, features and advantages of the present invention will be readily apparent to those skilled in the art when the following description of the preferred embodiment is read in conjunction with the accompanying drawings.

DETAILED DESCRIPTION OF PREFERRED EMBODIMENT

As used herein, an "electric" element includes one that can conduct electric current. "Wire" refers to a relatively small, discrete electric current conductor of any suitable cross-sectional shape as distinguished from a conductive mass such as a tool body used in a well.

Figure 1:
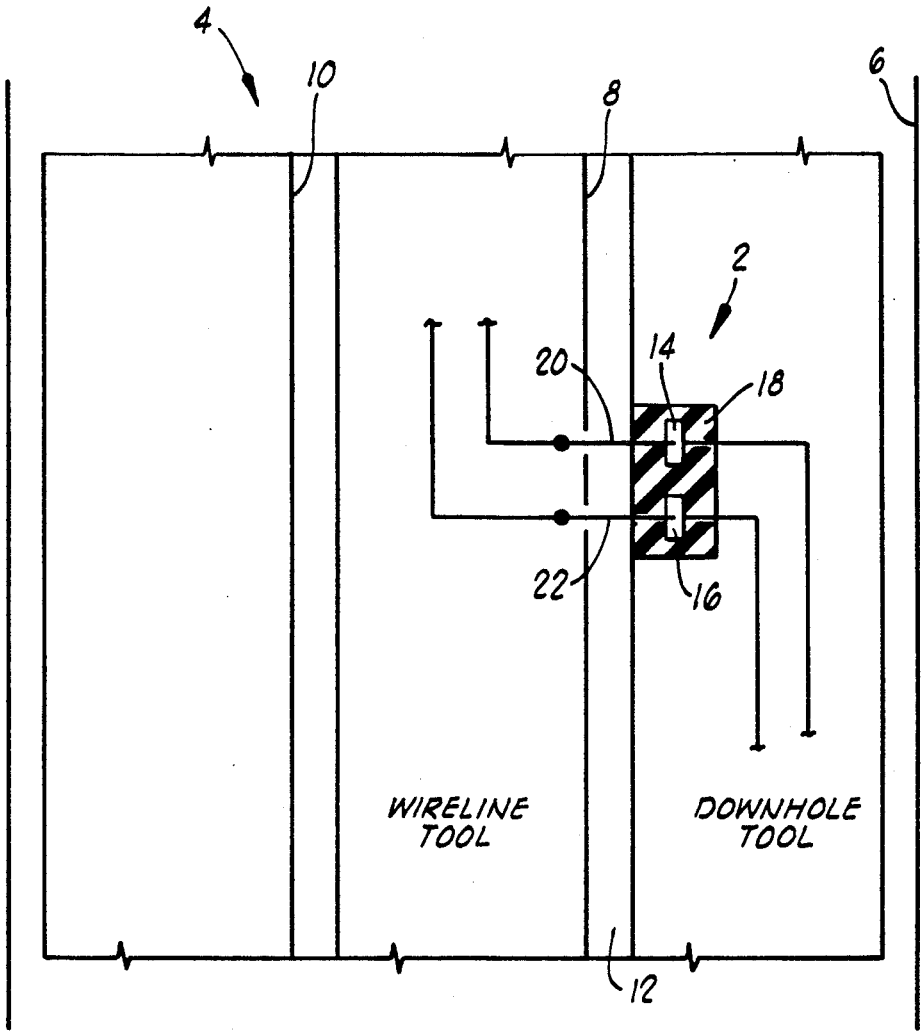
FIG. 1 is a schematic and block diagram of a coupling apparatus within a data communicating apparatus of the present invention.

Referring to FIG. 1, an electric coupling 2 of the present invention is schematically represented within the block representation of a particular apparatus 4 for communicating data in a well 6. The apparatus 4 includes a cylindrical wireline tool 8 and an annular downhole tool 10.

The electric coupling 2 is used to couple two electric circuits. In the FIG. 1 embodiment, one circuit is in the wireline tool 8 and one circuit is in the downhole tool 10 so that coupling occurs across an intervening space 12 between the tools. The space 12 can contain electrically conductive wellbore fluid (e.g., salt water). Particular circuits will be described hereinbelow with reference to FIG. 2.

In the preferred embodiment, the electric coupling 2 has a portion mounted on the downhole tool 10 and a portion mounted on the wireline tool 8. The portion on the downhole tool 10 includes two electric members 14, 16 connected to the circuit in the tool 10 but disposed in a sealing member 18 (FIG. 1) or respective sealing members 18*a*, 18*b* (FIG. 4C).

In the preferred embodiment, each member 14, 16 is made of a wire mesh screen. In a particular implementation, the screen is made of 0.0045" diameter copper wire, three-strand, R98, 4" wide manufactured by Metex Corporation of Edison, N.J. The sealing member or members fluid tightly seal the respective screens within a self-sealing membrane or membranes that can be penetrated by the portion of the electric coupling 2 mounted on the wireline tool 8. The membrane seals around the penetrating element, and it seals itself if the penetrating element is removed. In a particular implementation, the seal(s) 18 is (are) made of compound S-124 manufactured by LTV Energy Division—Oil State Industries, Lampasses, Tex.

The portion of the electric coupling 2 on the wireline tool 8 includes means, connected to the circuit in the tool 8, for penetrating the sealing member or members 18 and electrically contacting the two electric members 14, 16. This penetrating and contacting means includes two electric contacts 20, 22. The contacts 20, 22 are slender enough and pointed enough to pierce the sealing member 18 or the respective sealing members 18*a*, 18*b*. Such type of contacts can be referred to as electric pins. In a particular implementation, these are made of gold-plated, hardened beryllium copper. When appropriately moved, as explained hereinbelow, each such pin pierces the adjacent sealing member and wire mesh screen to make direct mechanical and electrical contact with the respective screen as illustrated in FIG. 1. Portions of the contacts 20, 22 making this connection cross the space 12 and are exposed to whatever is in the space 12.

Although the FIG. 1 embodiment shows both contacts 20, 22 connected to the electric circuit of the wireline tool 8 and both contact receivers 14, 16 connected to the electric circuit of the downhole tool 10, the specific association between a contact or a receiver and a particular circuit can be varied in the broader aspects of the present invention. For example, a contact and a receiver could be associated with one circuit and the respective mating receiver and contact associated with the other circuit.

The circuits themselves may be of any desired type. In the preferred embodiment further described hereinbelow, the circuits include toroidal core and coil subassemblies linked by a wire loop connected by the previously described electric coupling; however, it is contemplated that the circuits can be directly connected in a continuous current path via the electric coupling. The latter is not preferred because it is contemplated that directly connected circuits may present too much input resistance or impedance to the respective circuits; in which case if short-circuiting occurs across the contacts 20, 22 due to fluid in the space 12 (or otherwise), the operation of the circuits may be adversely affected. Such adverse short-circuiting does not occur in the preferred embodiment because the input resistance and impedance of the short wire loop formed through the electric coupling 2 is less than that of any current conductive path which may exist between the contacts 20, 22 in the space 12. Thus, appreciable current flow remains in the wire loop of the preferred embodiment even if a conductive path exists between contacts 20, 22 in the space 12. In the preferred embodiment, the wire loop is electrically insulated from the main structural bodies of the wireline tool 8 and the downhole tool 10, and it has a resistance of less than about 1 ohm and more preferably less than about 0.15 ohm.

Figure 2:
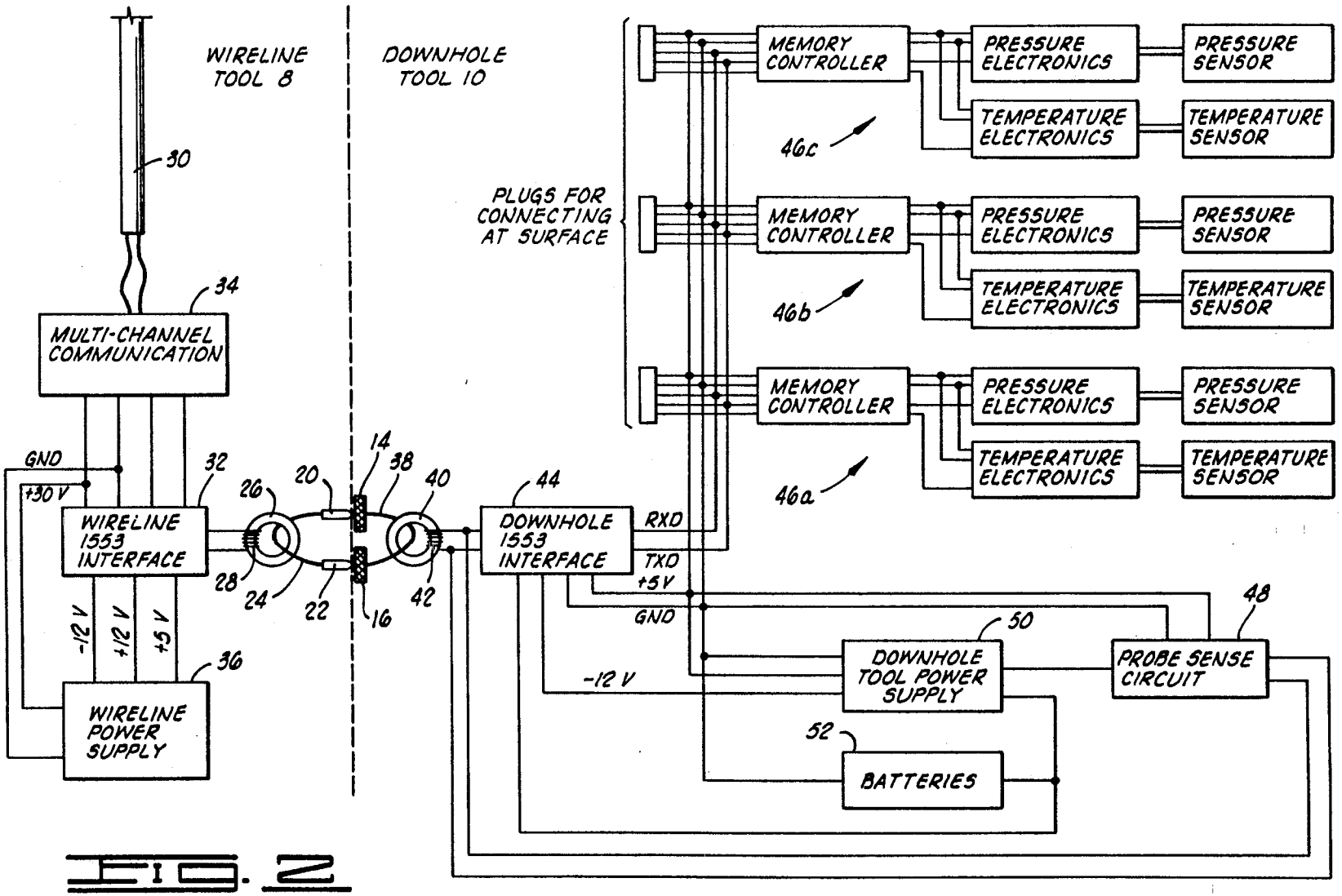
FIG. 2 is a more detailed schematic and block diagram of the data communicating apparatus, with coupling apparatus, of the preferred embodiment.

The preferred current loop type of circuit is illustrated in FIG. 2. In the wireline tool 8, the ends of a single wire 24 are connected to the contacts 20, 22. The wire 24 is threaded through a toroidal core 26 on which a coil 28 is wound. The coil 28 is connected to a wireline 30 by suitable means. In the FIG. 2 embodiment, this means includes a 1553 interface 32 and a multichannel communication circuit 34 powered by a power supply 36 energized from a direct current energy source at the surface, all of which is conventional as known in the art (1553 is a known protocol and others can be used; the use of 1553 in the particular implementation is applied at a relatively slow communication rate to allow less expensive, more readily available, and less power consuming parts to be used). The wireline 30 is also conventional and is used in a known manner to move the wireline tool 8, and thus the components within it, into and out of the well 2. The wireline 30 provides a means for powering the wireline tool 8 from the surface and transmitting data between the surface and the wireline tool.

In the downhole tool 10, the ends of a wire 38 are connected to the contact receivers 14, 16. The wire 38 is threaded through a toroidal core 40 on which a coil 42 is wound.

In the FIG. 2 embodiment, the coil 42 is connected through a 1553 interface 44 to means for obtaining data from the well 6. This means includes three (but more or less can be used) pressure and temperature sensing and recording circuits 46*a*, 46*b*, 46*c*. Each of these circuits includes pressure and temperature sensors and a memory controller. Each memory controller is a microcomputer-based data acquisition device that can measure time, sample pressure and temperature signals from the sensors, convert the signals to binary values, store the binary values in non-volative memory (e.g., EEPROM), transmit stored data and real time data and receive programming or command information.

The coil 42 is also connected to a probe sense circuit 48 which responds to electrical signals sent to the downhole tool 10 through the wireline tool 8.

Although power can be coupled through the electric coupling of the present invention, primary power is provided in the downhole tool 10 by a power supply 50 energized by batteries 52.

The components 44–52 are conventional as known in the art.

As is apparent from FIG. 2, the engaged contacts 20, 22 and contact receivers 14, 16 connect the wires 24, 38 to form an electric current conductive single-turn wire loop that links the coils 28, 42 which are inductively coupled to the loop through the cores 26, 40, respectively. This loop conducts current that is induced in response to a time-varying electric current in either of the coils 28, 42. This induced current in turn induces current in the other coil.

Figure 3A:
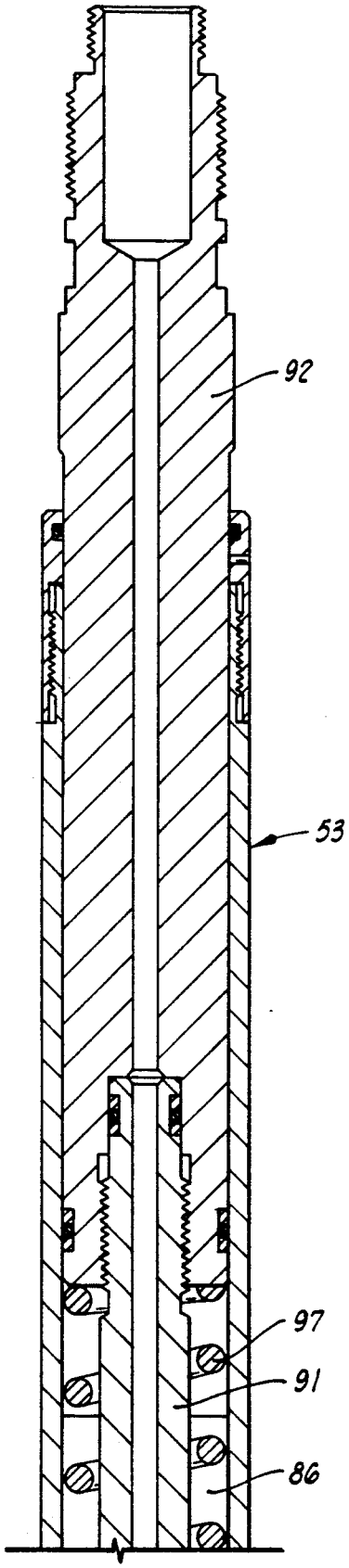
FIGS. 3A–3G show an elevational sectional view of a wireline tool of a particular implementation of the preferred embodiment of the present invention.
Figure 3B:
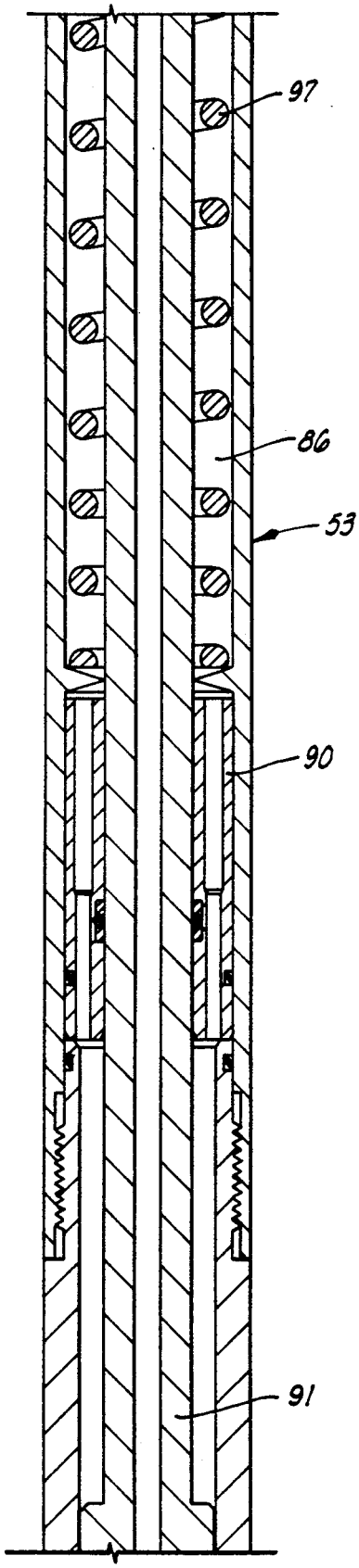
Figure 3C:
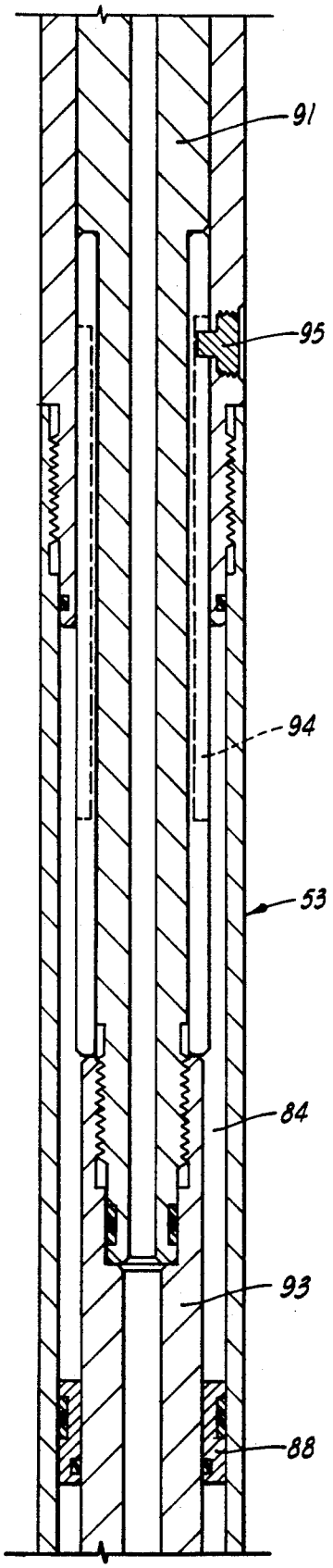
Figure 3D:
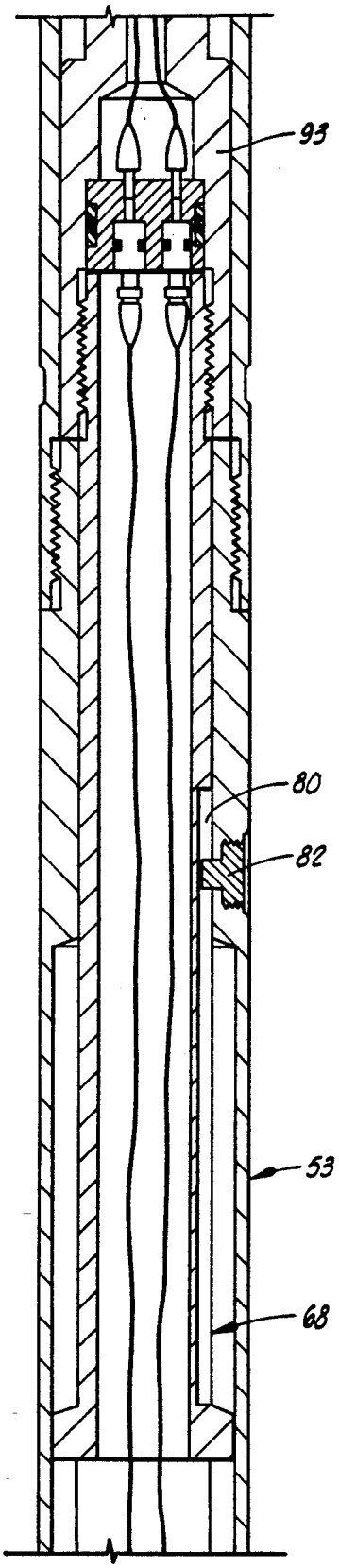
Figure 3E:
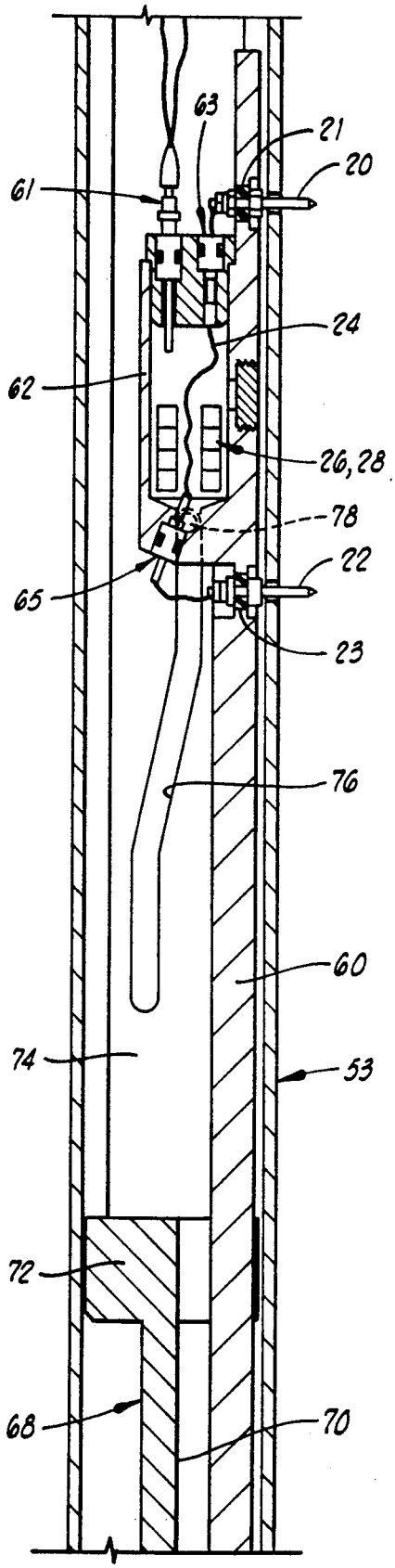
Figure 3F:
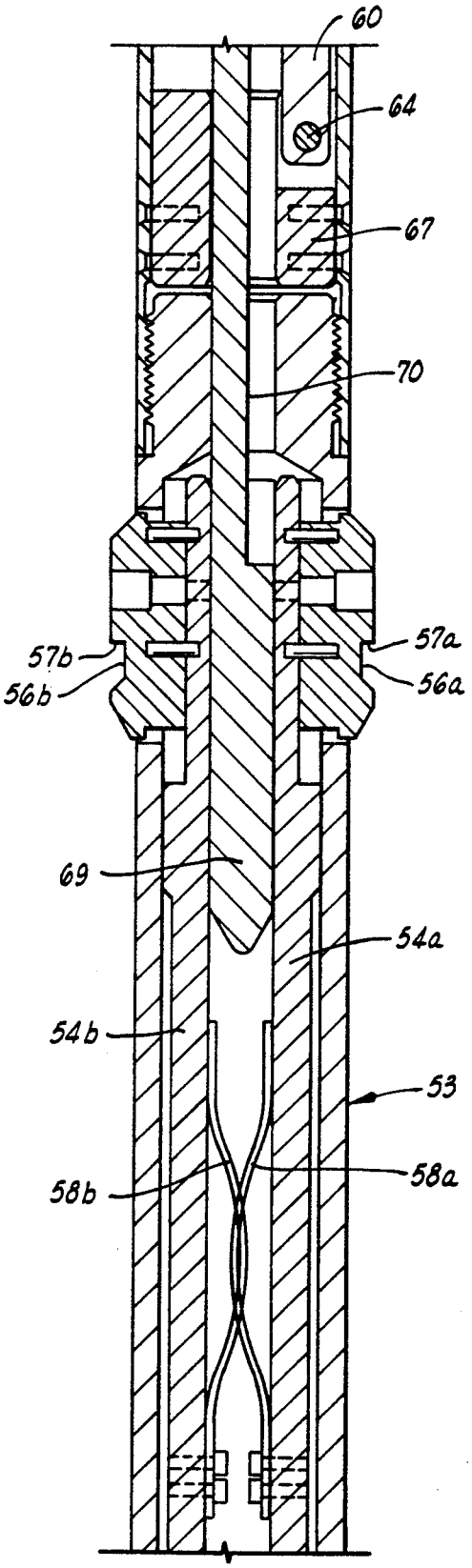
Figure 3G:
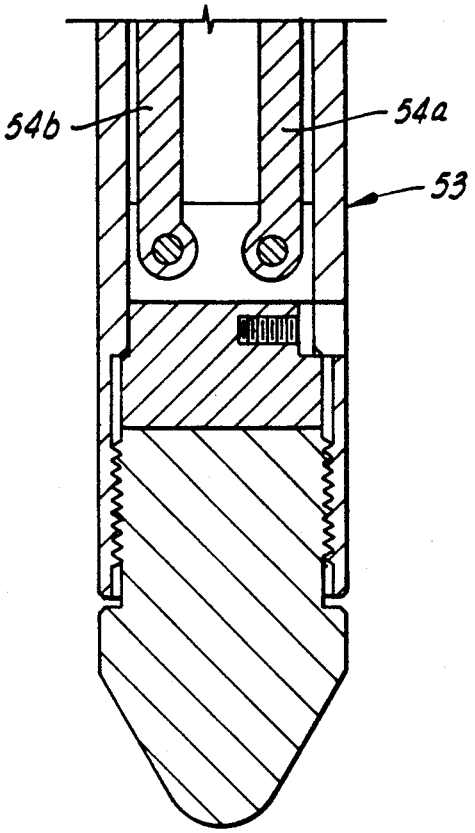

Referring to FIGS. 3A–3G, a particular implementation of the wireline tool 8 will be described beginning at the bottom of the tool in FIG. 3G.

The wireline tool 8 includes an outer cylindrical case or housing 53. Latching arms 54*a*, 54*b* are pivotally connected in the bottom portion of the housing 53. Locking dogs 56*a*, 56*b* (FIG. 3F) are mounted on the upper ends of the arms 54*a*, 54*b*, respectively. The profile on the outside of each of the dogs complements a latching groove on the inner diameter of the particular downhole tool 10 described hereinbelow. There are downwardly facing 90 degree shoulders 57*a*, 57*b* on the dogs. These shoulders keep the wireline tool 8 from moving past the latching groove in the downhole tool 10. Leaf springs 58*a*, 58*b* keep the latching arms 54*a*, 54*b* and locking dogs 56*a*, 56*b* biased outwardly.

A contact arm 60 (FIGS. 3E and 3F) supports the wireline toroidal core 26 and coil 28 subassembly and the two pointed metal contacts 20, 22. The core and coil subassembly is retained in a receptacle 62 near the upper end of the arm 60. The contacts 20, 22 face radially outward from insulative feedthroughs 21, 23, respectively, disposed in the arm 60 to electrically isolate the contacts 20, 22 from, and to pass them through, the wall of the arm 60. Other electrical feedthroughs, also such as from Kemlon in Houston, allow connections to be made with the coil 28 (three used for allowing two end connections and one grounded center-tapped connection to be made, but only one, feedthrough 61, is visible in FIG. 3E) and to pass the wire 24 (feedthroughs 63, 65). These components are disposed with the contacts 20, 22 and the wire 24 electrically insulated from the housing 53 and contact arm 60 so that the current flows through the contacts 20, 22 and the wire 24 and not the wireline tool body or contact arm. The arm 60 is pivotally connected at its lower end inside the housing 53 by means of a pivot pin 64 (FIG. 3F) disposed in a block 67 attached to the housing 53.

The outward extension of the pointed metal contacts 20, 22 is controlled by a slotted mandrel 68 (FIGS. 3D–3F) slidably disposed in the housing 53. On the bottom end of the mandrel 68 (FIG. 3F), there is a tapered cylinder 69 approximately ¾" in diameter. When the mandrel 68 is in its lower position (the one shown in FIG. 3), this portion 69 keeps the latching arms 54*a*, 54*b* from retracting. The ¾" diameter is milled to approximately one-half its width along a portion 70. This provides room for the contact arm 60 when it is retracted and the wireline tool 8 is not latched in the downhole tool 10.

From the milled diameter portion 70, the outer diameter of the mandrel 68 is approximately 1¾". In this portion 72 (FIG. 3E), there is a slot 74 that is wider than the contact arm 60, which is partially located inside the wider slot 74. There are two j-slots in the slotted mandrel 68, one on each side of the slot 74 (only one, slot 76, is shown in FIG. 3E). The two j-slots work in conjunction with two protruding pins (only pin 78 shown in FIG. 3E) on the contact arm 60 to control the position of the contact arm 60. When the slotted mandrel 68 is in its down position as shown in FIG. 3, the contact arm 60 is extended. When the slotted mandrel 68 is in its up position, the contact arm 60 is retracted and the pointed contacts 20, 22 are inside the outer diameter of the housing 53 of the wireline tool 8.

There is a straight slot 80 (FIG. 3D) on the slotted mandrel 68 above the slot 74. A pin 82 in the outer case 53 extends into this straight slot 80 to prevent rotation of the mandrel 68 with respect to the case 53 and the contact arm 60.

There is a hydraulic metering system in the wireline tool 8. Its purpose is to delay the downward movement of the slotted mandrel 68 so that the latching arms and the pointed contacts are not prematurely extended if the wireline tool 8 should hang inadvertently on a shoulder while running in the hole The metering system includes a lower chamber 84 (FIG. 3C), an upper chamber 86 (FIGS. 3A and 3B), a floating piston 88 (FIG. 3C) and a metering cartridge 90 (FIG. 3B). The metering system is preferably filled with silicone oil (e.g., DC 200 from Dow Corning). The inner diameters of the chambers 84, 86 are defined at least in part by a cylindrical member 91 connected at its lower end to the mandrel 68 via a cylindrical coupling 93 (FIGS. 3C and 3D) that supports the piston 88, and at its upper end to an upper piston 92 (FIG. 3A).

The floating piston 88 provides a reference of the wireline tool hydrostatic pressure to the lower chamber 84. When weight is applied to the wireline tool 8, it acts on the upper piston 92 in the wireline tool 8 and pressure is applied in the upper chamber 86. The pressurized oil in the upper chamber 86 is metered through the metering cartridge 90 having a restrictor valve, such as a Lee Visco Jet manufactured by the Lee Company. As the oil is metered, the slotted mandrel 68 slowly moves downwardly. The timing is controlled by the size of the metering jets of the restrictor valve as known in the art. Preferably sizing is such that it requires the application of continuous weight for several minutes in order for the slotted mandrel 68 to move to its downwardmost position.

The j-slots 76 in the slot 74 portion of the mandrel 68, and its ¾" diameter portion 69 (FIGS. 3E and 3F), are arranged such that during downward movement of the mandrel 68 the latching arms 54*a*, 54*b* are first locked into position and then the contact arm 60 with the pointed contacts 20, 22 is extended transversely to the axis of the wireline tool 8 and the length of the well. This insures that the tool 8 is latched in the downhole tool 10 before the contacts 20, 22 establish electrical connection with the downhole tool 10.

When the wireline tool 8 is picked up, or downward weight is removed, the weight of the lower portion of the tool 8 and the force of a spring 97 generate pressure in the lower chamber 84. The metering cartridge 90 has check valves, such as those made by the Lee Company, in parallel with the metering jets and arranged so that high pressure in the lower chamber 84 communicates freely to the upper chamber 86. When this happens, the mandrel 68 quickly moves up, first retracting the contact arm 60 and then allowing the latching arms 54*a*, 54*b* to retract with wireline pull.

A continuous rotating j-slot 94 (FIG. 3C) is also in the metering system. The purpose of the j-slot 94 is to selectively block the upward movement of the mandrel 68. The rotating j-slot 94 is constructed such that once the wireline tool 8 is latched and the pointed contacts 20, 22 are in communication with the downhole tool 10, several up - down motions of the wireline 30 are required to retract the contacts 20, 22 and release the tool 8. The j-slot 94 works relative to a pin 95 connected to the housing 53.

When the tool 8 is released, the rotating j-slot 94 is in its original position and the tool 8 can be reset into the downhole tool 10 if desired. It is also possible to pull the wireline tool 8 to the surface and "park" it in a surface wireline lubricator. A valve on the surface, below the lubricator, can be closed so that the probe is on the surface, inside the lubricator, out of the flow stream, but still ready to go back in the well and latch into the downhole tool without having to rig down the lubricator to reset the probe.

Figure 5:
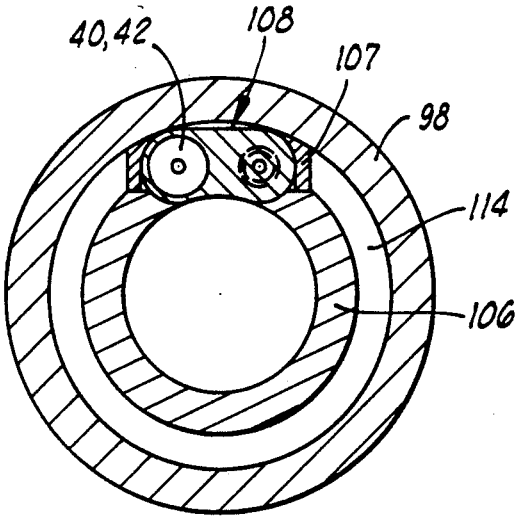
FIG. 5 is a sectional view taken along line 5—5 in FIG. 4.

The wireline tool 8 can move on the wireline 30 in the well 6 relative to the downhole tool 10, which downhole tool 10 is lowered into and fixed in the well 6 before the wireline tool 8 is used. When the wireline tool 8 is to communicate with the electric circuit of the downhole 10, however, the wireline tool 8 is latched into a landing receptacle 96 (FIG. 4) of the downhole tool 10 so that the housing 53 of the wireline tool 8 is then fixed relative to the downhole tool 10. It is the landing receptacle portion of the downhole tool 10 which is of particular interest to the preferred embodiment of the present invention because it is this portion that carries the core 40 and coil 42 subassembly and the fluid sealed contact receiving screens 14, 16. A particular implementation of the landing receptacle 96 is shown in FIGS. 4 and 5.

The landing receptacle 96 has a body including a cylindrical outer case 98 (FIGS. 4A–4E). At the top of the outer case 98 there is connected an end coupling member 100 (FIG. 4A) which retains an inner structure of the body of the landing receptacle 96.

Figure 4A:
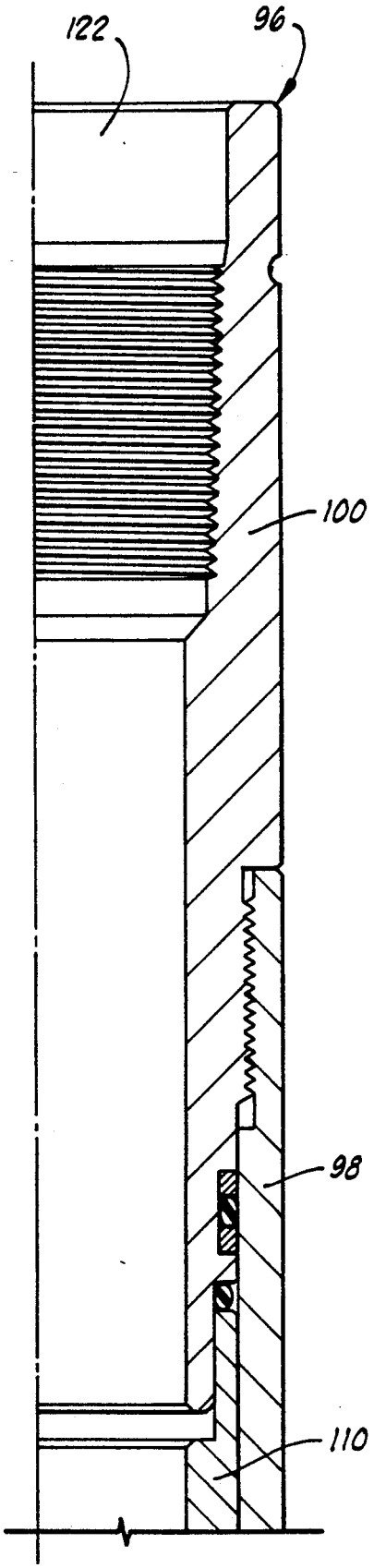
FIGS. 4A–4E show an elevational sectional view of a landing receptacle portion of a downhole tool of a particular implementation of the preferred embodiment of the present invention.
Figure 4B:
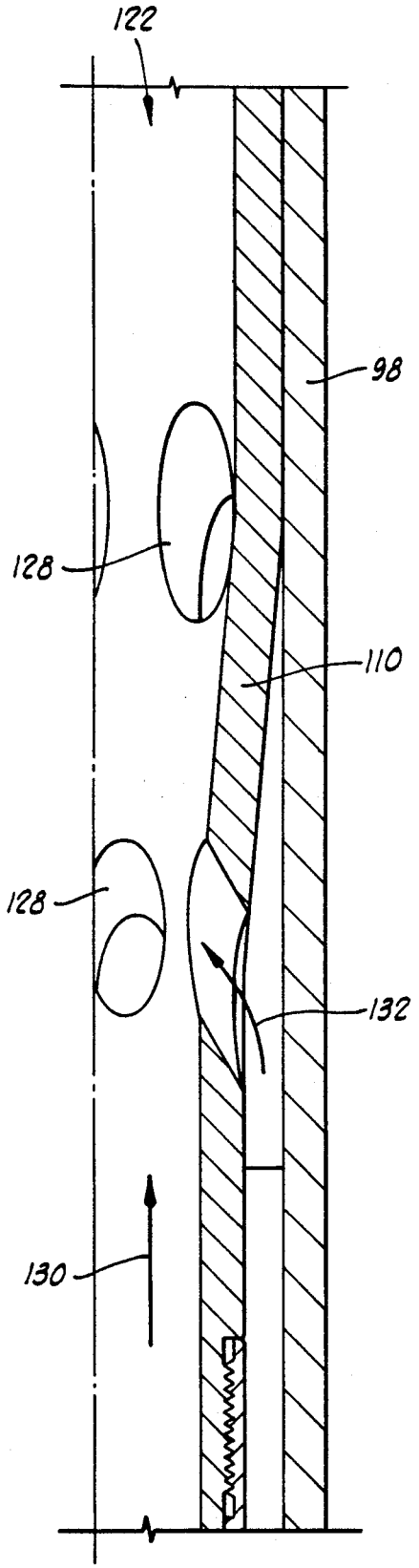
Figure 4C:
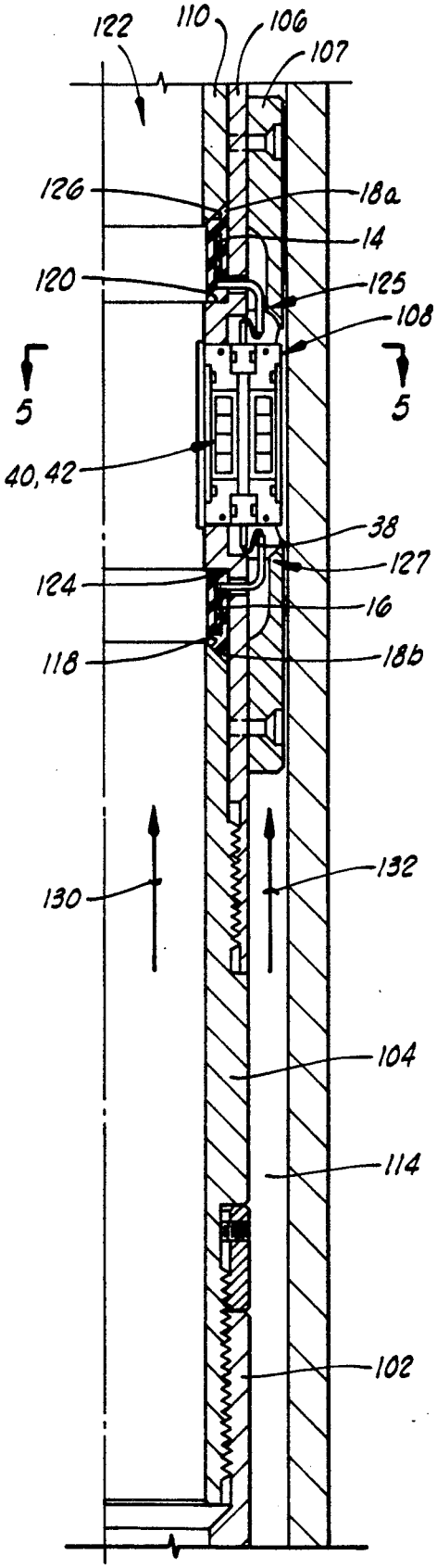

The inner structure of the landing receptacle 96 body includes, from bottom to top, a landing profile member 102 (FIGS. 4C–4E), a support adapter 104 (FIG. 4C), a support 106 (FIG. 4C) supporting a block 108 containing the core 40 and coil 42 subassembly, and a flow port member 110 (FIGS. 4A–4C).

The landing profile member 102 has holes 112 (FIG. 4E) near its lower end to allow fluid flow to an annulus 114 between the member 102 and the outer case 98 when the wireline tool 8 is latched in the landing receptacle 96. This latching occurs when the latch dogs 56*a*, 56*b* (FIG. 3F) are deployed outwardly into landing profile 116 (FIG. 4D) of the landing profile member 102.

The upper end of the landing profile member 102 connects to the lower end of the support adapter 104 (FIG. 4C). The upper end of the adapter 104 connects to the support 106. Connected to the outer surface of the support 106 is a housing 107 to protect the core 40 and coil 42 subassembly housed inside from fluid that flows through the annulus 114.

Referring to FIG. 4C, the support 106 has the annular screen 14/seal 18*a* and screen 16/seal 18*b* combinations bonded to it adjacent upwardly facing shoulder 120 and downwardly facing shoulder 124, respectively, so that these elements form a unitary structure. The screen 14/seal 18*a* combination extends axially towards a beveled lower edge 126 of the flow port member 110, and the screen 16/seal 18*b* combination extends axially towards a beveled upper edge 118 of the adapter 104. The radially inner surface of each annular seal with embedded screen is exposed to an axial opening 122 which extends throughout the inner structure of the landing receptacle 96 and into which the wireline tool 8 is adapted to be moved.

The seal members 18*a*, 18*b* electrically insulate the screens 14, 16 from the body of the downhole tool 10, and conventional feedthroughs 125, 127 electrically insulate the interconnecting wire 38 from the body of the downhole tool 10.

More specifically, the support 106 is a metallic housing to which two contact rings of copper wire mesh surrounded by silicone rubber are bonded. The rubber completely encapsulates the mesh. It electrically insulates the metallic housing from the mesh contact rings. It also acts as a seal, protecting the mesh from corrosive effects of well bore fluids. Thus, at least the inner radial thickness of the rubber should be soft enough to "heal" an opening caused by the contact pins after they are retracted. This should help minimize the exposure of the mesh to well bore fluids and reduce corrosion effects on the mesh. Furthermore, the rubber impregnates the mesh. That is, it fills the voids in the mesh so that if the "healing" action of the rubber is ineffective in preventing corrosion, corrosion will be localized to the immediate vicinity of an opening. Since the rubber/-wire mesh rings are continuous around the inner diameter of the downhole tool 10 and rotation of the probe or wireline tool 8 is not restricted, reentry of the pins will likely be at a "fresh", different place in the ring each time it is run, and so multiple successful connections should be obtainable without withdrawing either of the tools. Additionally, piercing the rubber will have a wiping action on the pins, further increasing the chances of obtaining a good connection.

To make the screens 14, 16 of a particular implementation, flat mesh is cut and folded twice into a strip. The open edges of the folds are soldered together, the ends of the strip are soldered together to form a ring and a wire is attached to the ring with solder. Two of these rings and the metallic housing are then molded together with the rubber to make the completed structure.

The flow port member 110 is connected between the upper end of the support 106 and the lower end of the end member 100. The flow port member 110 has holes 128 (FIG. 4B) to allow fluid to return to the axial opening 122 from the annulus 114. The primary flow path when the wireline tool 8 is not in the axial opening 122 is indicated in FIGS. 4B–4E by arrows 130, and the primary flow path when the wireline tool 8 is latched in the axial opening 122 is indicated by arrows 132.

The remainder of the downhole tool 10 can be conventional. By way of example only, in a particular implementation suitable for the downhole data collection circuit illustrated in FIG. 2, the lower end of the downhole tool 10 is connected to a conventional full flow tester valve. A pressure porting sleeve intermediate the tester valve and the landing receptacle 96 has three holes in its top end to receive the three pressure sensors depicted in FIG. 2. The ports can be used such that the pressure sensors sense the same pressure or any desired combination of formation pressure, wellbore annulus pressure and tubing pressure. Because the frequencies of the output signals from the pressure sensors, which frequencies indicate the sensed pressure, are dependent on temperature, the temperature sensors depicted in FIG. 2 are located with the pressure sensors.

Preferably, a heavy gauge steel pressure tubing (e.g., such as that manufactured by Autoclave Engineers) (not shown) disposed in the annulus 114 protects wires connecting the core 40 and coil 42 subassembly with the downhole electrical circuit from external downhole fluid (the coil 42 has two end connections and a grounded center-tapped connection in the particular implementation).

When the downhole tool 10 is run, the individual memory controllers (FIG. 2) will record pressure and temperature data by storing encoded signals in nonvolatile memory.

Figure 4D:
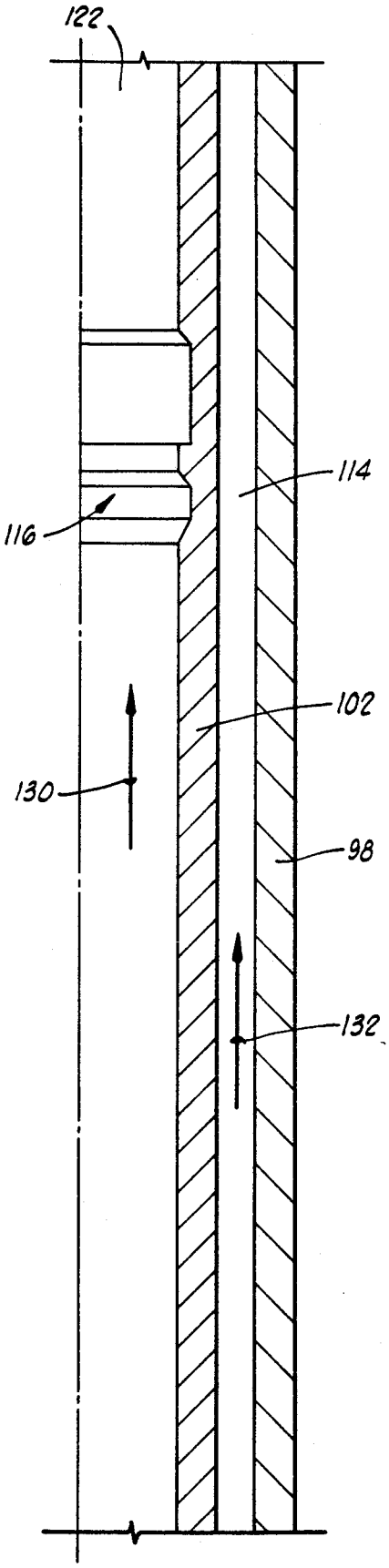
Figure 4E:
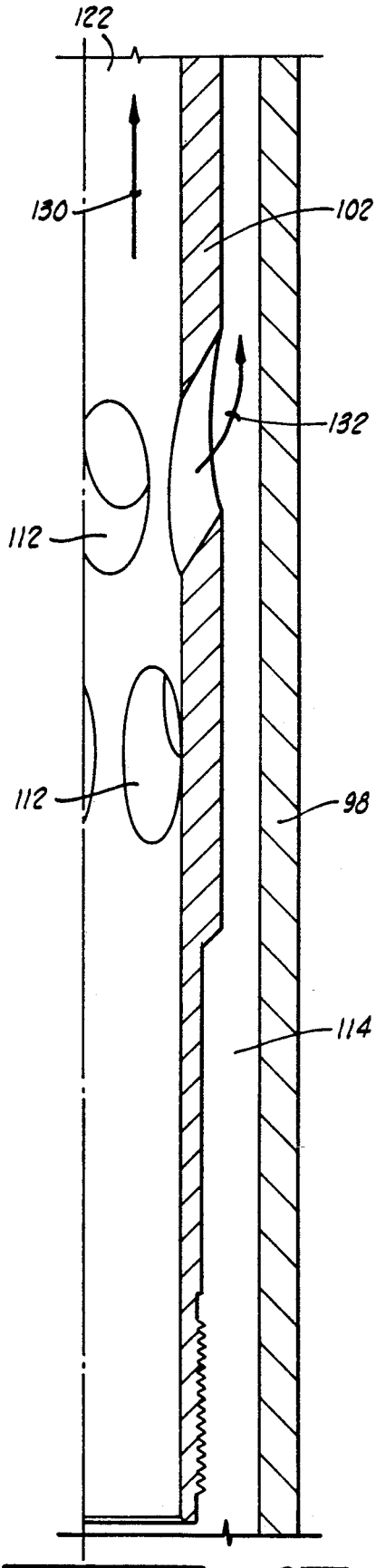

When data retrieval is desired, the wireline tool 8 is run into the axial opening 122 and latched into the downhole tool 10. The locking dogs 56*a*, 56*b* lock into the series of grooves defining the profile 116 on the inner surface of the landing profile member 102 of the landing receptacle 96 (FIG. 4D). When the dogs 56*a*, 56*b* latch, the two pointed metal contacts 20, 22 are thereby aligned with the sealed contact receivers 14, 16. As previously described, this latching occurs by moving the mandrel 68 downwardly.

This downward movement eventually also causes the contacts 20, 22 to be extended from the outer diameter of the wireline tool 8. That is, as the mandrel 68 moves downwardly, the shape of the slot 76 moves the pin 78, and thus the contact arm 60, so that the contacts 20, 22 extend outside the housing 53 as shown in FIG. 3E. In moving to this position, the contacts 20, 22 pierce or puncture the seals 18*a*, 18*b*, respectively, and the wire mesh contact receivers 14, 16, respectively, to make direct electric connections between the contacting pair 14, 20 and the contacting pair 16, 22. As illustrated in FIG. 2, this establishes a single turn wire loop linking the toroidal core and coil subassemblies of the wireline tool 8 and downhole tool 10, thus establishing the communication link between the tools. In the illustrated embodiment, this current conductive link is established radially across the space 12 (FIG. 1) between the tools 8, 10. As previously mentioned, this link is distinct from any current conductive path in the bodies of the wireline tool 8 and the downhole tool 10 so that the resistance of this link can be sufficiently low that the current conductive path through the link is not effectively short-circuited by fluid in the space 12 crossed by the current conductive path.

In broader aspects of the present invention, one or more of the contact/contact receiver pairs can be used. Furthermore, such pair(s) can be used in and with different types of circuits, whether including inductive or direct ohmic continuity.

Signals from the wireline tool 8 are picked up in the probe sense circuitry 48 (FIG. 2) in the downhole tool 10. This turns on the −12 V DC power supply 50 in the downhole tool 10.

In the particular implementation containing the FIG. 2 circuits, three "switch" commands sent from the surface through the wireline tool 8 tell the downhole tool 10 from which memory controller to retrieve data. The switch commands are received by the downhole 1553 interface 44. The interface 44 then selects the designated memory controller.

After the 1553 interface 44 starts communicating with a particular controller, the controller starts sending its latest measured pressure and temperature value to the surface.

A "dump" command can then be issued from the surface. This operator initiated command instructs the controller to begin sending stored data to the surface. After all stored data is sent, the controller continues by sending the latest measured pressure and temperature value. The controller typically should be able to transmit stored data to the surface much faster than new data is stored. Therefore, several hours worth of stored data should be transmitted to the surface in several minutes. Sending data to the surface does not interfere with the controller's sampling and recording of pressure and temperature. In a particular implementation, it is contemplated that the data transfer rate from the downhole tool 10 up to the surface via the wireline tool 8 will be approximately 75 kilobaud, but the overall operating range for the particular implementation is from about 20 kilobaud to about 200 kilobaud. Other rates can be accommodated by optimizing core size, core material, winding size, and/or number of turns for the desired rate(s). Cores in the illustrated particular implementation are from Magnetics, Inc. Communication is bidirectional.

Data is sent to the surface in multiple byte blocks. The checksum of each block is calculated and appended to each block. A surface computer calculates its own checksum of the data block and compares it to the checksum transmitted from the downhole tool. If the two checksums match, nothing happens, the surface computer just waits for the next block of data.

If the two checksums do not match, there is an error in the block received at the surface. The surface computer will automatically issue a "resend" command. This command is received by the controller which is in communication with the surface. The controller must back-up several blocks and re-send previous data that was corrupted during its original transmission to the surface.

Thus, the present invention is well adapted to carry out the objects and attain the ends and advantages mentioned above as well as those inherent therein. While a preferred embodiment of the invention has been described for the purpose of this disclosure, changes in the construction and arrangement of parts and the performance of steps can be made by those skilled in the art, which changes are encompassed within the spirit of this invention as defined by the appended claims.

What is claimed is:

1. An apparatus for communicating electrical signals in a well, comprising:

a first electric coil adapted to be moved in the well;

a second electric coil adapted to be fixed in the well relative to movement of said first electric coil in the well;

current conducting means for having an electric current induced therein in response to an electric current in a selected one of said first and second electric coils, and for inducing an electric current in the other of said first and second electric coils in response to the electric current induced in said current conducting means, said current conducting means including:

a first electric wire linked with said first electric coil;

a second electric wire linked with said second electric coil; and means for connecting said first and second electric wires in the well so that an electric current conductive wire loop links said first and second electric coils.

2. An apparatus as defined in claim 1, further comprising:

a landing receptacle having said second electric coil mounted thereon, said landing receptacle having an axial opening; and a wireline tool having said first electric coil mounted thereon, said wireline tool including means for connecting said first electric coil to a wireline, and said wireline tool adapted to be moved on the wireline within the axial opening of said landing receptacle.

3. An apparatus as defined in claim 2, wherein said means for connecting includes:

a first wire mesh member connected to one end of said second electric wire;

a second wire mesh member connected to the other end of said second electric wire;

seal means for fluid tightly sealing said first and second wire mesh members on said landing receptacle; and means, connected to said first electric wire, for penetrating said seal means and electrically contacting said first and second wire mesh members.

4. An apparatus as defined in claim 3, wherein said means for penetrating and contacting includes a first pin, connected to one end of said first electric wire, and a second pin, connected to the other end of said first electric wire.

5. An apparatus as defined in claim 4, wherein said seal means includes a self-sealing membrane for maintaining a seal after being penetrated by at least one of said first and second pins.

6. An apparatus as defined in claim 1, wherein said means for connecting includes:

a first wire mesh member connected to one end of said second electric wire;

a second wire mesh member connected to the other end of said second electric wire;

seal means for fluid tightly sealing said first and second wire mesh members from fluid in the well; and means, connected to said first electric wire, for penetrating said seal means and electrically contacting said first and second wire mesh members.

7. An apparatus as defined in claim 6, wherein said means for penetrating and contacting includes a first pin, connected to one end of said first electric wire, and a second pin, connected to the other end of said first electric wire.

8. An apparatus as defined in claim 7, wherein said seal means includes a self-sealing membrane for maintaining a seal after being penetrated by at least one of said first and second pins.

9. An apparatus as defined in claim 1, wherein said wire loop extends radially between said first and second electric coils in response to said connecting means connecting said first and second electric wires.

10. An apparatus for communicating data between a wireline tool body and a downhole tool body in a well, comprising:

a first toroidal core and coil subassembly carried in the wireline tool body but electrically insulated therefrom;

a first wire coupled with said first toroidal core and coil subassembly and electrically insulated from the wireline tool body;

first and second electric contacts connected to said first wire and electrically insulated from the wireline tool body; and means, connected to the wireline tool body, for moving said first and second electric contacts;

a second toroidal core and coil subassembly carried in the downhole tool body but electrically insulated therefrom;

a second wire coupled with said second toroidal core and coil subassembly and electrically insulated from the downhole tool body;

first contact receiving means, connected to said second wire and electrically insulated from the downhole tool body, for receiving said first electric contact;

second contact receiving means, connected to said second wire and electrically insulated from the downhole tool body, for receiving said second electric contact; and a sealing member disposed adjacent at least said first contact receiving means, said sealing member penetrated by at least said first electric contact in response to said moving means moving said first and second electric contacts into said first and second contact receiving means.

11. An apparatus as defined in claim 10, wherein:

said first electric contact includes a first electric pin connected to one end of said first wire;

said second electric contact includes a second electric pin connected to the other end of said first wire;

said first contact receiving means includes a first electric screen connected to one end of said second wire;

said second contact receiving means includes a second electric screen connected to the other end of said second wire; and at least said first electric screen is disposed adjacent said sealing member so that said first electric pin penetrates said sealing member and said first electric screen in response to movement of said pins by said moving means.

12. An apparatus as defined in claim 11, wherein said moving means includes:

support means for supporting said first toroidal core and coil subassembly, said first wire and said first and second pins; and means for pivoting said support means toward the downhole tool body when the wireline tool body is adjacent the downhole tool body.

13. An apparatus as defined in claim 12, wherein:

said means for pivoting includes:

means for pivotally connecting said support means inside the wireline tool body; and a mandrel slidably disposed within the wireline tool body, said mandrel having a slot defined therein; and said support means includes a protuberance disposed for traveling in the slot of said mandrel so that as said mandrel moves in a first direction relative to the wireline tool body, said pins supported by said support means are pivoted toward said first and second electrical screens, and further so that as said mandrel moves in a second direction relative to the wireline tool body, said pins supported by said support means are pivoted away from said first and second electric screens.

14. An apparatus as defined in claim 10, wherein said moving means includes:

support means for supporting said first toroidal core and coil subassembly, said first wire and said first and second electric contacts; and means for pivoting said support means toward the downhole tool body when the wireline tool body is adjacent the downhole tool body.

15. An apparatus as defined in claim 14, wherein:

said means for pivoting includes:

means for pivotally connecting said support means inside the wireline tool body; and a mandrel slidably disposed within the wireline tool body, said mandrel having a slot defined therein; and said support means includes a protuberance disposed for traveling in the slot of said mandrel so that as said mandrel moves in a first direction relative to the wireline tool body, said first and second electric contacts supported by said support means are pivoted toward said first and second contact receiving means, and further so that as said mandrel moves in a second direction relative to the wireline tool body, said first and second electric contacts supported by said support means are pivoted away from said first and second contact receiving means.

16. An electric coupling for first and second electric circuits in a well, comprising:

an electric contact connected to the first electric circuit;

contact receiving means, connected to the second electric circuit, for receiving said electric contact; and seal means for sealing said contact receiving means and for being penetrated by said electric contact in response to connecting said electric contact and said contact receiving means together.

17. An electric coupling as defined in claim 16, wherein:

said first electric contact includes a pin;

said contact receiving means includes a screen; and said screen is disposed adjacent said seal means so that said pin penetrates said seal means and said screen in response to movement of said pin and said screen together.

18. An electric coupling as defined in claim 17, wherein said seal means includes a self-sealing membrane for maintaining a seal after being penetrated by said pin.

19. An electric coupling as defined in claim 16, wherein said seal means includes a self-sealing membrane for maintaining a seal after being penetrated by said electric contact.

20. An electric coupling as defined in claim 16, further comprising means for moving said electric contact through said seal means and into said contact receiving means.

21. An electric coupling as defined in claim 20, wherein said moving means includes:

support means for supporting said electric contact; and means for pivoting said support means toward said seal means.

22. An electric coupling as defined in claim 21, wherein:

said means for pivoting includes:

a housing;

means for pivotally connecting said support means to said housing; and a mandrel slidably disposed within said housing, said mandrel having a slot defined therein; and said support means includes a protuberance disposed for traveling in the slot of said mandrel so that as said mandrel moves in a first direction relative to said housing, said electric contact supported by said support means is pivoted toward said seal means, and further so that as said mandrel moves in a second direction relative to said housing, said electric contact supported by said support means is pivoted away from said seal means.

23. A method of communicating between two electric circuits in a well, comprising establishing, across an intervening space in the well between the two electric circuits, a current conductive wire path having a resistance less than about 1 ohm so that the current conductive wire path is not effectively short-circuited by fluid in the intervening space crossed by the current conductive wire path.

24. A method of communicating between two electric circuits in a well, comprising, establishing, across an intervening space in the well between the two electric circuits, a current conductive path so that the current conductive path is not effectively short-circuited by fluid in the intervening space crossed by the current conductive path, wherein each of the electric circuits includes a respective toroidal core and coil subassembly and the current conductive path includes a wire loop linked with the toroidal cores and coils.

25. A method of communicating between two electric circuits in a well, comprising establishing, across an intervening space in the well between the two electric circuits, a current conductive path so that the current conductive path is not effectively short-circuited by fluid in the intervening space crossed by the current conductive path, wherein establishing the current conductive path includes moving two electric contacts and two contact receivers coupled to the electric circuits together so that an intervening seal is penetrated and direct electric connections are made between respective pairs of the contacts and receivers.

26. A method of communicating between two electric circuits in a well, comprising establishing, across an intervening space in the well between the two electric circuits, a current conductive path so that the current conductive path is not effectively short-circuited by fluid in the intervening space crossed by the current conductive path, wherein establishing the current conductive path includes moving two pins, coupled to one of the circuits, within the well so that the pins pierce at least one sealing member and engage two screens sealed from the fluid by the at least one sealing member and coupled to the other circuit.

27. A method of communicating between two electric circuits in a well, comprising establishing, across an intervening space in the well between the two electric circuits, a current conductive path so that the current conductive path is not effectively short-circuited by fluid in the intervening space crossed by the current conductive path, wherein establishing the current conductive path includes:

moving a housing, which housing pivotally supports two electric contacts coupled to one of the electric circuits but electrically insulated from the housing, into position in the well so that the electric contacts are aligned with at least one sealing member fluid tightly sealing from the fluid two contact receivers coupled to the other electric circuit disposed in the well; and moving a mandrel in the housing for pivoting the electric contacts toward the at least one sealing member so that the electric contacts penetrate the at least one sealing member and engages the contact receivers.

28. A method for coupling electric circuits in a well, comprising moving an electric contact, coupled to one circuit in the well, through a seal fluid tightly protecting a contact receiver, coupled to another circuit in the well, and into engagement with the contact receiver.

29. A method as defined in claim 28, wherein the electric contact includes a pin and the contact receiver includes a wire mesh member.

* * * * *